US011561046B2

(12) United States Patent
Cain

(10) Patent No.: US 11,561,046 B2
(45) Date of Patent: Jan. 24, 2023

(54) CAMPFIRE CRUCIBLE AND METHOD OF USE

(71) Applicant: Brian T. Cain, Franklin, TN (US)

(72) Inventor: Brian T. Cain, Franklin, TN (US)

( * ) Notice: Subject to any disclaimer, the term of this patent is extended or adjusted under 35 U.S.C. 154(b) by 31 days.

(21) Appl. No.: 17/032,749

(22) Filed: Sep. 25, 2020

(65) Prior Publication Data

US 2021/0095924 A1 Apr. 1, 2021

Related U.S. Application Data

(60) Provisional application No. 62/907,027, filed on Sep. 27, 2019.

(51) Int. Cl.
*F27B 14/10* (2006.01)
*F27B 14/02* (2006.01)
*F27B 14/08* (2006.01)

(52) U.S. Cl.
CPC ..... *F27B 14/10* (2013.01); *F27B 14/02* (2013.01); *F27B 2014/0831* (2013.01)

(58) Field of Classification Search
CPC .. F27B 14/10; F27B 14/02; F27B 2014/0831; B25J 1/12
See application file for complete search history.

(56) References Cited

U.S. PATENT DOCUMENTS 2,398,768 A * 4/1946 Cadwell ..... C22B 5/04 149/37
3,188,684 A * 6/1965 Calogero ..... A47J 45/071 294/34
D921,459 S * 6/2021 Holsinger ..... D8/14
2021/0095924 A1* 4/2021 Cain ..... F27B 14/02

FOREIGN PATENT DOCUMENTS

CN 207415186 U * 5/2018
CN 207682220 U * 8/2018

* cited by examiner

*Primary Examiner* — Scott R Kastler
(74) *Attorney, Agent, or Firm* — Technology Law, PLLC; Robert C. Corbett

(57) ABSTRACT

A crucible assembly is suited for use melting aluminum cans at a campfire or similar fire. The crucible assembly may include a handle design that facilitates safe and easy handling of the crucible after it has been heated and contains melted aluminum. The crucible assembly may also include a portion having a convex surface that maintains contact with the ground during rotation of the crucible, thereby providing support and stability to the crucible as melted aluminum is poured therefrom.

9 Claims, 6 Drawing Sheets

CAMPFIRE CRUCIBLE AND METHOD OF USE

CROSS-REFERENCE TO RELATED APPLICATIONS

This application claims the benefit of U.S. Provisional Patent Application No. 62/907,027, filed Sep. 27, 2019, and which is hereby incorporated by reference in its entirety.

TECHNICAL FIELD

This disclosure relates to crucibles for melting metals.

BACKGROUND

Aluminum cans are used for containing and transporting beverages, such as soda and beer. When camping or staying in remote areas that lack recycling or disposal facilities, gathering and transporting empty cans to a recycling facility can be cumbersome and time-consuming.

SUMMARY

A crucible assembly is provided that facilitates the melting of aluminum cans at campfires, thereby reducing the volume of the cans in order to make transportation to a recycling facility easier. The use of the crucible assembly to melt cans and then pour the resulting liquid metal into assorted shapes also provides entertainment during camping.

According to one aspect of the present invention, the crucible assembly includes a handle design that improves control, weight balance, and safety compared to prior art handles. According to another aspect of the present invention, the crucible assembly includes a support member having a curved, convex surface affixed to the crucible. The support member enables the crucible to be rotated for pouring the molten aluminum while also maintaining constant contact with the ground for stability and support.

The above features and advantages and other features and advantages of the present disclosure are readily apparent from the following detailed description of the best modes for carrying out the disclosure when taken in connection with the accompanying drawings.

DESCRIPTION OF THE PREFERRED EMBODIMENTS

Figure 1:
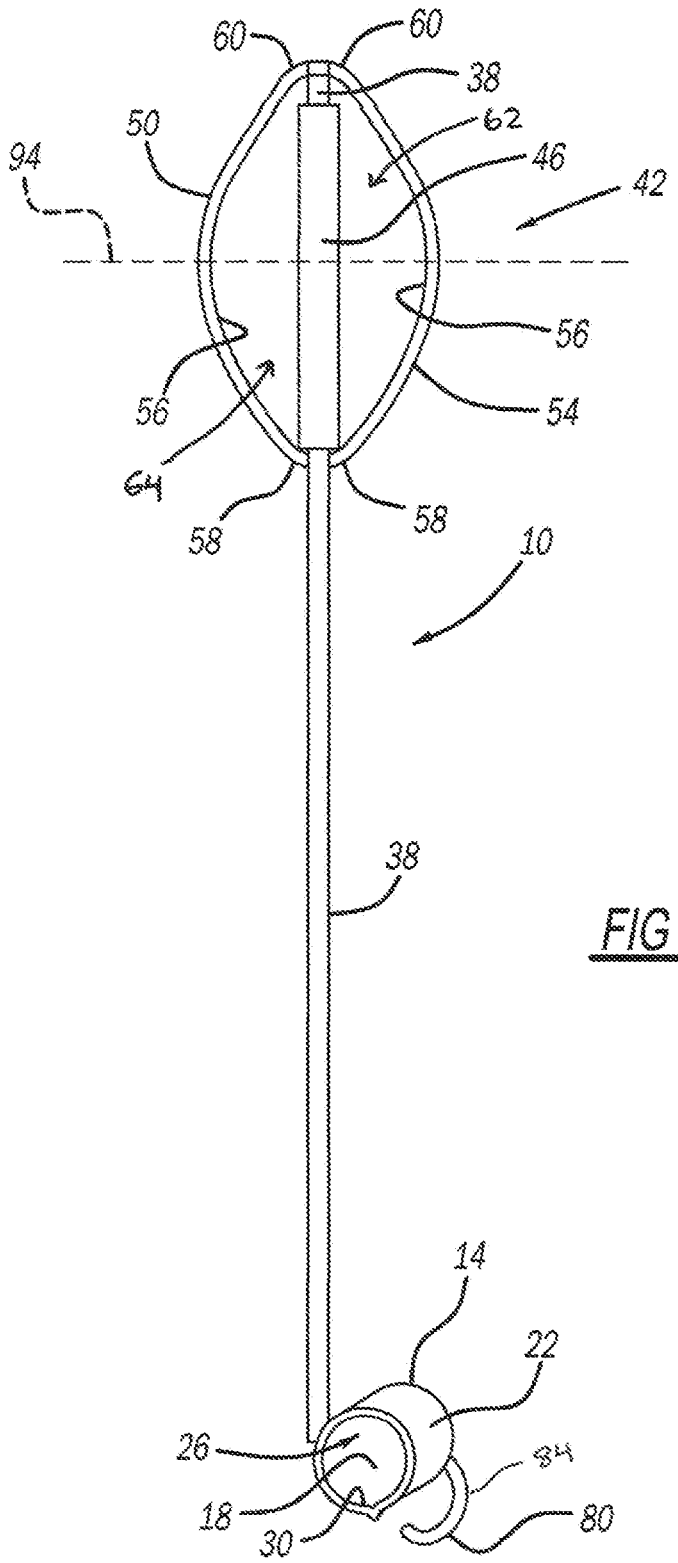
FIG. 1 is a schematic, front view of a crucible assembly, including a crucible, shaft, and handle assembly.
Figure 2:
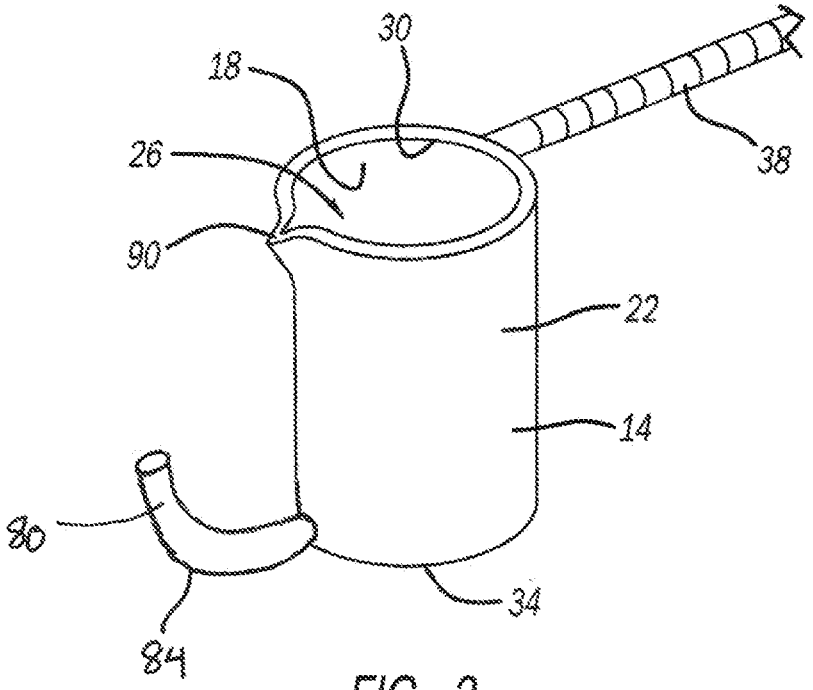
FIG. 2 is a schematic, perspective view of the crucible attached to the shaft.

Referring to the Figures, wherein like reference numbers refer to like components throughout, a crucible assembly 10 is schematically depicted. The crucible assembly 10 includes a crucible 14. In the embodiment depicted, the crucible 14 includes a generally cylindrical inner surface 18 and a generally cylindrical outer surface 22. The inner surface 18 defines a generally cylindrical chamber 26. The crucible 14 defines a generally circular opening 30 to the chamber 26. The crucible 14 includes a generally flat base portion 34 at the end opposite the opening 30.

The crucible 14 may be comprised of any material that can remain in the solid state at the temperatures found in a campfire or other wood or charcoal fire. Similarly, the crucible may have any dimensions or geometry within the scope of the claimed invention, but preferably the chamber 26 is large enough to contain a standard twelve-ounce aluminum beverage can. In the embodiment depicted, the crucible 14 is made from steel pipe having either a 2.7 or 3 inch inner diameter and a 3.5 inch outer diameter.

The crucible assembly 10 also includes a shaft 38 mounted with respect to the crucible 14, such as by welding. The shaft 38 is preferably between three feet and six feet in length; in the embodiment depicted, the shaft 38 is four feet in length. In the embodiment depicted, the shaft 38 is steel rebar (½ inches in diameter) welded to the outer surface 22 of the crucible 14 adjacent the opening 30 such that the shaft 38 is within approximately 30 degrees of being perpendicular to the generally cylindrical crucible 14.

A handle assembly 42 is operatively connected to the end of the shaft 38 opposite the crucible 14. As used herein, a handle that is "operatively connected" to the shaft includes handles that are integrally formed with the shaft, as well as handles that are separate pieces mounted with respect to the shaft. The handle 42 includes a first portion, which, in the embodiment depicted, is a hollow, cylindrical member 46 through which the shaft 38 extends. In the embodiment depicted, the member 46 is wood, but other materials suitable for contact with the hands of a user may be employed within the scope of the claimed invention, including, but not limited to, various polymers.

The handle 42 further includes a second portion 50 and a third portion 54. Each of the second and third portions 50, 54 defines a respective concave surface 56, a respective first end 58, and a respective second end 60. Each of the first and second ends 58, 60 is operatively connected to the first handle portion and the shaft 38. In the embodiment depicted, the first ends 58 are connected to the shaft 38 on one side of the member 46, and the second ends 60 are connected to the shaft on the other side of the member 46. In the embodiment depicted, the ends 58, 60 are welded to the shaft 38; however, those of ordinary skill in the art will recognize a variety of joining and attachment methods that may be employed within the scope of the claimed invention.

The concave surface 56 of each of portions 50, 54 cooperate with member 46 to define open spaces 62, 64 therebetween. More specifically, the member 46 and the concave surface 56 of portion 54 define open space 62 therebetween; the member 46 and the concave surface 56 of portion 50 define open space 64 therebetween.

Figure 4:
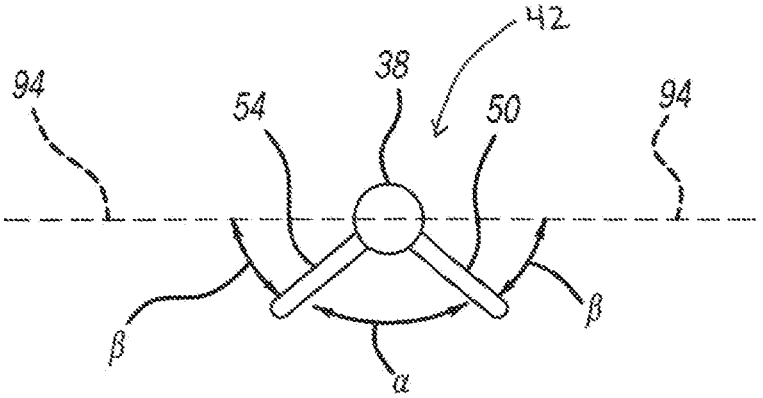
FIG. 4 is a schematic view of the shaft and handle assembly as viewed from the centerline of the shaft.
Figure 3:
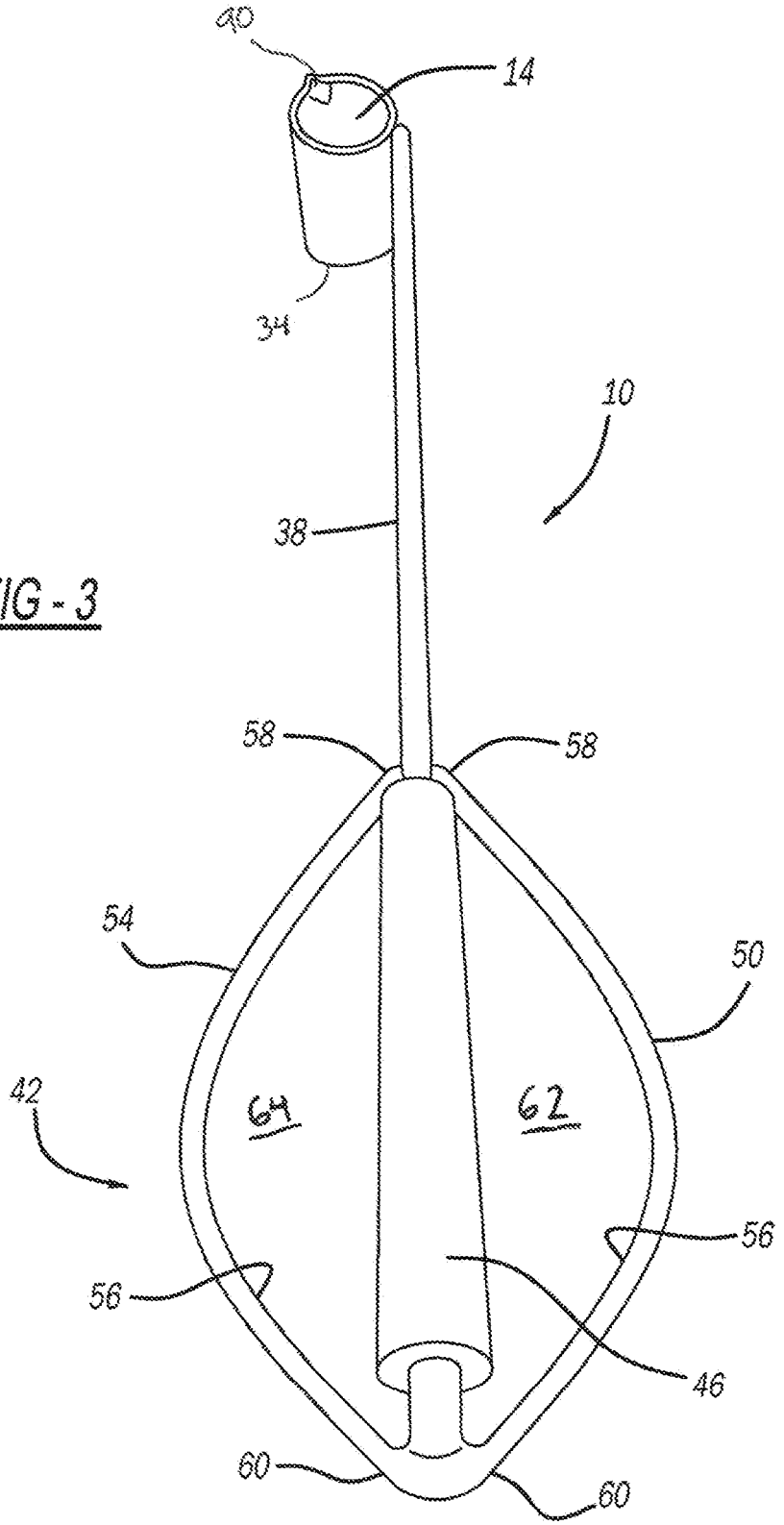
FIG. 3 is a schematic, perspective view of the crucible assembly.
Figure 5:
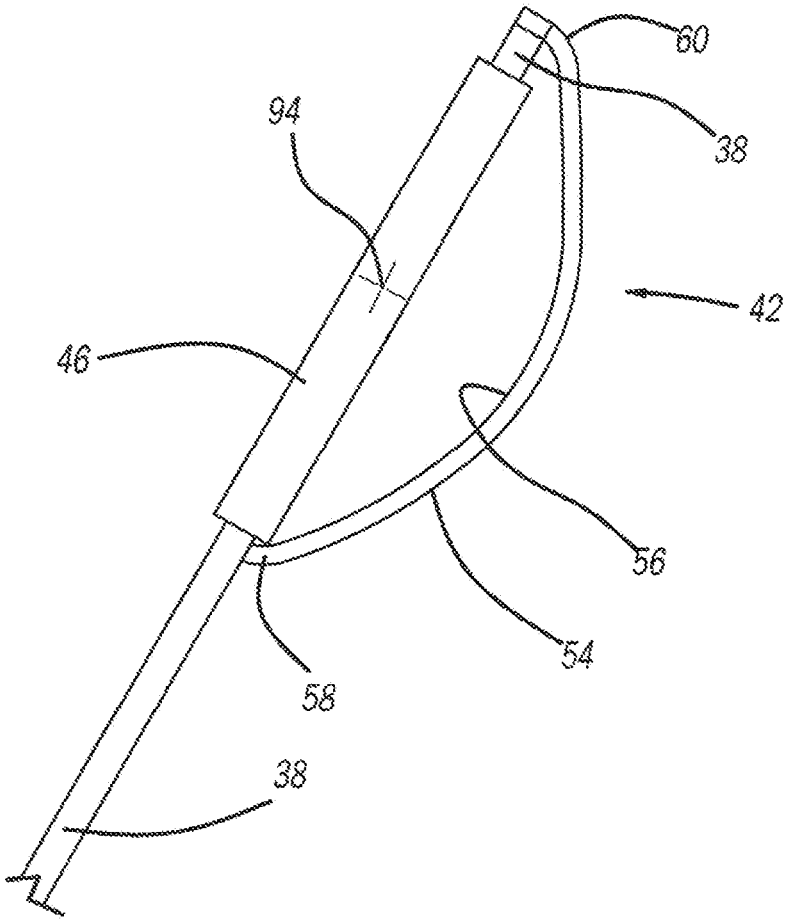
FIG. 5 is a schematic, side view of the handle assembly.

Referring specifically to FIG. 4, the second and third portions 50, 54 define an angle $\alpha$ therebetween that is preferably between 110 degrees and 170 degrees, and more preferably between 130 degrees and 150 degrees. In one embodiment, the angle $\alpha$ is 140 degrees. In the embodiment depicted, the second and third portions are bent metallic rods, though other materials may be used within the scope of the claimed invention.

Figure 6:
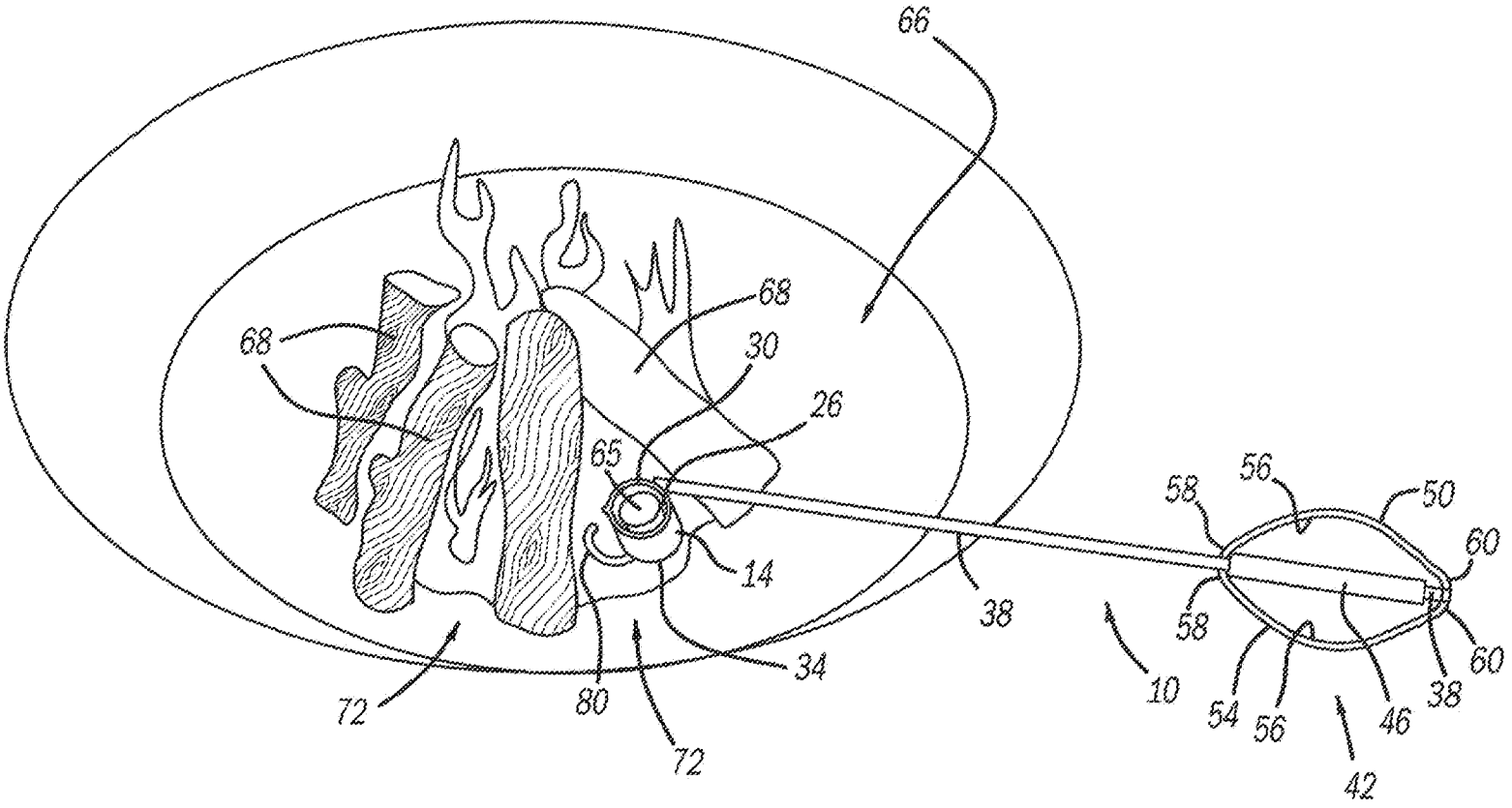
FIG. 6 is a schematic, perspective view of the crucible assembly in heat transfer communication with a campfire.
Figure 7:
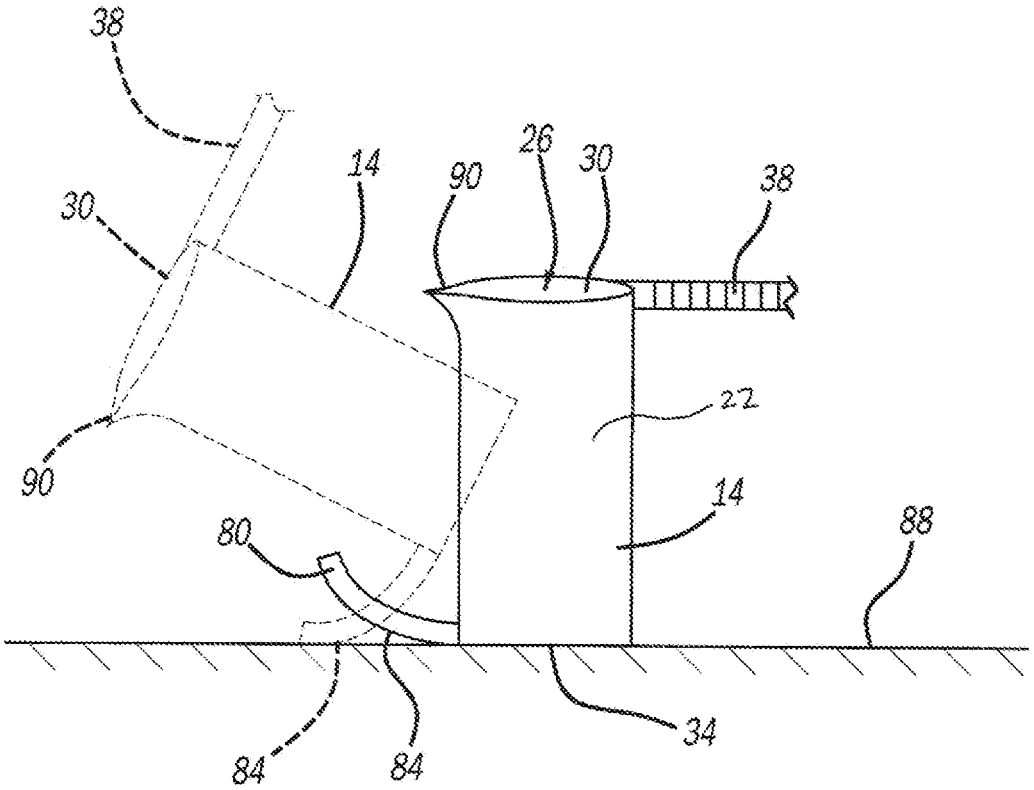
FIG. 7 is a schematic, side view of a portion of the crucible assembly in contact with the ground.

FIGS. 6 and 7 schematically depict a method of use for the crucible assembly 10. Referring specifically to FIG. 6, the method includes placing an aluminum can 65 in the crucible 14. More specifically, the can 65 is placed into the chamber 26 through the opening 30. The method also includes causing the aluminum can 65 to melt by placing the crucible 14 (with the can therein) in heat transfer relationship with a wood 68 and/or charcoal 72 fire 66. In the embodiment depicted, the fire and the wood and coals are disposed within a fire pit.

Referring to FIG. 7, the crucible assembly 10 includes a support member 80 operatively connected to the outer surface 22 of the crucible 14. The support member 80 defines a convex surface 84 that is substantially adjacent to or contiguous with the planar base surface 34. The method further includes placing crucible assembly 10 in a first position in which the base surface 34 of the crucible 14 is on the ground 88 or other support surface after the aluminum can 65 has melted. The method also includes rotating the crucible 14 to a second position (shown in phantom in FIG. 7) such that the convex surface 84 remains in contact with the ground 88 during said rotating, and the melted aluminum is poured out of the crucible 14 via a spout 90 formed in the opening 30.

In the embodiment depicted, the support member 80 is a curved piece of 1 inch rebar measuring 5 linear inches that is rolled and welded in an angled manner to the crucible 14, though other materials may also be employed within the scope of the claimed invention. Alternatively, and within the scope of the claims, the support member 80 may be integrally formed as part of the crucible 14.

Referring again to FIG. 4, the second and third portions 50, 54 are also positioned such each of the second and third portions 50, 54 form an angle β with a line 94 that is perpendicular to the shaft 38 and the cylindrical member 46. When the assembly 10 is positioned such that the base surface 34 is on a flat surface, as shown in FIGS. 6 and 7, line 94 is horizontal. Angle β is preferably between 15 and 35 degrees, and, more preferably between 20 and 30 degrees. In the embodiment shown in the drawings, the angle β is 25 degrees. The handle 42 is symmetrical about a plane; the plane of symmetry of the handle is substantially vertical when the assembly 10 is in its typical use position, and the centerline of the shaft 38 is contained within the plane.

While the best modes for carrying out the invention have been described in detail, those familiar with the art to which this invention relates will recognize various alternative designs and embodiments for practicing the invention within the scope of the appended claims.

The invention claimed is:

1. An apparatus comprising:

a crucible;

a shaft operatively connected to the crucible; and a handle assembly operatively connected to the shaft;

wherein the handle assembly includes a first portion, a second portion, and a third portion;

wherein each of the second and third portions defines a respective first end and a respective second end;

wherein the second portion defines a first concave surface;

wherein the third portion defines a second concave surface;

wherein the first and second ends of the second and third portions are mounted with respect to the first portion such that the first concave surface cooperates with the first portion to define a first open space and the second concave surface cooperates with the first portion to define a second open space; and wherein the second and third portions form an angle therebetween, said angle being between 110 degrees and 170 degrees.

2. The apparatus of claim 1, wherein the angle is between 130 degrees and 150 degrees.

3. The apparatus of claim 1, wherein the first portion includes a member and the shaft extends through the member.

4. The apparatus of claim 3, wherein the second and third portions are bent rods.

5. The apparatus of claim 1, wherein the crucible defines a generally planar base; and wherein the apparatus further comprises a support member operatively connected to the crucible and defining a convex surface that is substantially contiguous with the planar base.

6. An apparatus comprising:

a crucible defining a chamber, and an outer surface including a substantially planar base;

a shaft operatively connected to the crucible;

a handle operatively connected to the shaft; and a support member having a convex surface that is contiguous with the planar base.

7. A method comprising:

possessing a crucible assembly having a crucible defining a substantially planar base surface, a shaft mounted to the crucible, and a support member defining a convex surface mounted to the crucible such that the convex surface is substantially contiguous with the planar base surface;

placing solid aluminum in the crucible;

causing the aluminum to melt by placing the crucible in heat transfer relationship with a wood or charcoal fire;

placing the base surface on the ground; and rotating the crucible such that the convex surface contacts the ground and the melted aluminum is poured out of the crucible.

8. The method of claim 7, wherein the solid aluminum is an aluminum can.

9. The method of claim 8, wherein the wood or charcoal fire is a campfire.

* * * * *